US006347831B1

(12) United States Patent
Nye et al.

(10) Patent No.: US 6,347,831 B1
(45) Date of Patent: Feb. 19, 2002

(54) FOLDABLE PICNIC TABLE WITH TELESCOPING PEDESTALS AND BENCH SUPPORTS

(75) Inventors: Stephen F. Nye, Syracuse; Carl R. Stanford, Clinton; Glenn Merrill, Ogden, all of UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 09/419,963

(22) Filed: Oct. 18, 1999

(51) Int. Cl.[7] ..... A47B 3/00

(52) U.S. Cl. ..... 297/158.4; 297/118

(58) Field of Search ..... 297/135, 157.1, 297/158.3, 158.4, 159.1, 173, 170, 172, 118; 108/17, 106, 179, 127, 147.21, 147.19

(56) References Cited

U.S. PATENT DOCUMENTS

| | | | | |
|---|---|---|---|---|
| 769,354 | A | 9/1904 | Nielsen | |
| 1,063,642 | A | 6/1913 | Birdsall | |
| 1,272,187 | A | 7/1918 | Basford | |
| 1,296,336 | A | 3/1919 | Stine | |
| 1,351,013 | A | 8/1920 | Stine | |
| 1,514,418 | A | 11/1924 | Battenfeld | |
| 1,594,572 | A | 8/1926 | Soltesz | |
| 1,659,840 | A | 2/1928 | Smith | |
| 1,823,484 | A | 9/1931 | Blumenthal | |
| 2,109,869 | A | 3/1938 | Ross | 155/123 |
| 2,257,550 | A | 9/1941 | Gay | 155/124 |
| 2,411,658 | A | 11/1946 | La Rue | 5/3 |
| 2,452,169 | A | 10/1948 | Wells | 155/123 |
| 2,512,473 | A | 6/1950 | Alch | 155/123 |
| 2,522,642 | A | 9/1950 | Schmidt | 155/124 |
| 2,524,198 | A | 10/1950 | La Rue | 155/123 |
| 2,548,682 | A | 4/1951 | Price | 155/124 |
| 2,558,465 | A | 6/1951 | Seymour | 155/43 |
| 2,568,622 | A | 9/1951 | Hagan | 155/123 |
| 2,579,934 | A | 12/1951 | Krasney | 311/83 |
| 2,583,247 | A | 1/1952 | Aja et al. | 155/123 |
| 2,621,710 | A | 12/1952 | Miller | 155/124 |
| 2,647,562 | A | 8/1953 | Hoffar | 155/124 |
| 2,661,792 | A | 12/1953 | Lysaght | 155/124 |
| 2,670,031 | A | 2/1954 | Melges | 155/124 |
| 2,690,210 | A | 9/1954 | Holick | 155/123 |
| 2,717,028 | A | 9/1955 | Villemure | 155/124 |

(List continued on next page.)

*Primary Examiner*—Milton Nelson, Jr.
(74) *Attorney, Agent, or Firm*—Workman, Nydegger & Seeley

(57) ABSTRACT

A folding picnic table is positionable between a platform and a picnic table configuration. The foldable picnic table includes a table top and two benches on opposing sides. The table top is pivotally supported by two telescoping support pedestals and the two benches are pivotally supported by two telescoping bench support members. The telescoping supports permit the support pedestals and bench support members to be positioned between an extended and a retracted position. The first and second bench support members are attached to the first and second ends of the benches, respectively and include a substantially horizontal segment disposed between telescoping bench supports pivotally attached to opposing benches. When the foldable picnic table is disposed in the stage or platform configuration, the table top is positioned in the same plane as the opposing benches. Alternatively, when the foldable picnic table is disposed in the picnic table configuration, the table top and the benches are positioned in different planes. To dispose the foldable picnic table in a compact storage position, the table top and the benches must be disposed within the same plane. The table top and benches are positioned in the same plane when the axis of rotation between the support pedestals and the table top, established by their pivotal connection, is collinear with the first and second axes of rotation, established by the telescoping bench supports pivotally connected at the first and second ends of the benches.

39 Claims, 8 Drawing Sheets

U.S. PATENT DOCUMENTS

| | | | | |
|---|---|---|---|---|
| 2,717,631 | A | 9/1955 | Howe | 155/124 |
| 2,722,971 | A | 11/1955 | Gallagher et al. | 155/124 |
| 2,748,837 | A | 6/1956 | Beller | 155/124 |
| 2,752,987 | A | 7/1956 | Smithers | 155/124 |
| 2,766,812 | A | 10/1956 | Schrader | 155/124 |
| 2,771,937 | A | 11/1956 | Wilson | 155/124 |
| 2,780,506 | A | 2/1957 | Howe | 311/89 |
| 2,788,059 | A | 4/1957 | Mackintosh | 155/124 |
| 2,800,379 | A | 7/1957 | Smithers | 311/99 |
| 2,805,708 | A | 9/1957 | Bohn | 155/124 |
| 2,811,197 | A | 10/1957 | Nimmo | 155/124 |
| 2,811,400 | A | 10/1957 | James | 311/16.5 |
| 2,825,390 | A | 3/1958 | Post | 155/124 |
| 2,837,141 | A | 6/1958 | Shore | 155/124 |
| 2,849,053 | A | 8/1958 | Beller et al. | 155/124 |
| 2,878,859 | A | 3/1959 | Howe et al. | 155/124 |
| 2,936,820 | A | 5/1960 | Blink et al. | 155/124 |
| 2,939,516 | A | 6/1960 | Drew | 155/124 |
| 2,959,209 | A | 11/1960 | Lakin | 155/43 |
| 2,978,754 | A | 4/1961 | Wilson | 20/1.123 |
| 2,983,308 | A | 5/1961 | Horowitz | 155/124 |
| 2,992,043 | A | 7/1961 | Nelson | 297/159 |
| 3,025,120 | A | 3/1962 | Howe | 311/92 |
| 3,027,209 | A | 3/1962 | Nielsen | 311/95 |
| 3,079,197 | A | 2/1963 | Mugler | 297/159 |
| 3,080,193 | A | 3/1963 | Nimmo | 297/159 |
| 3,096,866 | A | 7/1963 | Glass | 297/159 |
| 3,101,062 | A | 8/1963 | Kanzelberger | 108/37 |
| 3,112,954 | A | 12/1963 | Kanitz | 297/159 |
| 3,141,424 | A | 7/1964 | Seymour | 108/113 |
| 3,174,796 | A | 3/1965 | Brown | 297/159 |
| 3,191,991 | A | 6/1965 | Anderson et al. | 297/159 |
| 3,256,037 | A | 6/1966 | Giambalvo | 297/159 |
| 3,259,426 | A | 7/1966 | Shaw et al. | 297/159 |
| 3,273,936 | A | 9/1966 | Deavers | 297/159 |
| 3,276,815 | A | 10/1966 | Cardy | 297/159 |
| 3,337,262 | A | 8/1967 | Katzfey et al. | 297/159 |
| 3,357,729 | A | 12/1967 | Krueger | 287/98 |
| 3,410,232 | A | 11/1968 | Krueger | 108/146 |
| 3,429,283 | A | 2/1969 | Uhor | 108/11 |
| 3,545,738 | A | 12/1970 | Stagg | 269/325 |
| 3,574,393 | A | 4/1971 | Hughes | 297/157 |
| 3,580,632 | A | 5/1971 | Seymour | 297/157 |
| 3,650,560 | A | 3/1972 | Wohlk | 297/140 |
| 3,672,719 | A | 6/1972 | Haukedahl | 297/118 |
| 3,692,358 | A | 9/1972 | Sung | 297/159 |
| 3,731,971 | A | 5/1973 | Sjogren | 297/159 |
| 3,765,719 | A | 10/1973 | Silver | 297/170 |
| 3,788,696 | A | 1/1974 | Loewen | 297/159 |
| 3,797,884 | A | 3/1974 | Gutierrez | 297/159 |
| 3,857,343 | A | 12/1974 | Greenberg | 108/133 |
| 3,885,829 | A | 5/1975 | Haeger | 297/159 |
| 3,893,400 | A | 7/1975 | Grant | 108/63 |
| 3,994,527 | A | 11/1976 | Nikitits et al. | 297/159 |
| 4,040,658 | A | 8/1977 | Mayol | 297/159 |
| 4,043,277 | A | 8/1977 | Wallace | 108/35 |
| 4,047,754 | A | 9/1977 | Cathey | 297/157 |
| 4,052,100 | A | 10/1977 | Nikitits et al. | 297/159 |
| 4,060,275 | A | 11/1977 | Hansen | 297/159 |
| 4,064,812 | A | 12/1977 | Commanda | 108/36 |
| 4,070,057 | A | 1/1978 | Jones | 297/159 |
| 4,111,482 | A | 9/1978 | Jones | 297/159 |
| 4,131,311 | A | 12/1978 | Nikitits et al. | 297/159 |
| 4,157,089 | A | 6/1979 | Loughrey | 128/74 |
| 4,191,111 | A | 3/1980 | Emmert | 108/132 |
| 4,249,773 | A | 2/1981 | Giambalvo | 297/159 |
| 4,289,350 | A | 9/1981 | Thomas et al. | 297/172 |
| 4,330,151 | A | 5/1982 | Healey | 297/157 |
| 4,382,627 | A | 5/1983 | Dean | 297/194 |
| 4,415,199 | A | 11/1983 | Wright | 297/159 |
| 4,489,661 | A | 12/1984 | Fitzgerald | 108/113 |
| 4,537,443 | A | 8/1985 | Bray | 297/159 |
| 4,572,574 | A | 2/1986 | Fishhaber et al. | 297/159 |
| 4,596,196 | A | 6/1986 | Gunter et al. | 108/113 |
| 4,606,575 | A | 8/1986 | Kodet | 297/124 |
| 4,648,652 | A | 3/1987 | Van Kuren | 297/159 |
| 4,653,804 | A | 3/1987 | Yoo et al. | 297/159 |
| 4,700,987 | A | 10/1987 | Sraka et al. | 297/159 |
| 4,744,309 | A | 5/1988 | Kiesel et al. | 108/157 |
| 4,762,321 | A | 8/1988 | Chang | 273/30 |
| 4,826,244 | A | 5/1989 | Choi | 297/159 |
| 4,883,314 | A | 11/1989 | Sakong | 297/159 |
| 4,960,303 | A | 10/1990 | York | 297/159 |
| 5,007,673 | A | 4/1991 | Cheng | 297/159 |
| 5,018,785 | A | 5/1991 | Monson et al. | 297/159 |
| 5,029,938 | A | 7/1991 | Song | 297/159 |
| 5,109,778 | A | 5/1992 | Berkowitz et al. | 108/127 |
| 5,240,307 | A | 8/1993 | Jones et al. | 297/159 |
| 5,314,231 | A | 5/1994 | Otterbacher | 297/159 |
| 5,325,793 | A | 7/1994 | Martin | 108/130 |
| 5,411,314 | A | 5/1995 | Wallace | 297/158.4 |

FOLDABLE PICNIC TABLE WITH TELESCOPING PEDESTALS AND BENCH SUPPORTS

BACKGROUND OF THE INVENTION

1. Field of the Invention

The present invention relates to picnic tables and, more particularly to novel foldable picnic tables having telescoping pedestals and bench supports that are selectively movable between a picnic table configuration, a stage or platform configuration and a storage position.

2. Technical Background

Picnic tables offer the convenience of having a table top surface and seating for the table combined into one unit. Picnic tables also offer the advantage of being able to seat a large number of people around one table. Picnic tables are generally used outdoors and have become increasingly popular as more and more people spend their leisure time outside. Picnic tables can be found in backyards, parks, campsites and various other places. Picnic tables are also used indoors, primarily to provide temporary seating. For example, they are often used in cafeterias, gymnasiums, homes and other places.

Leaving a picnic table outside subjects it to potential damaging elements which could shorten the life span of the picnic table. Thus, it is often desirable to be able to store the picnic table in a protected area. The often temporary nature of indoor picnic table use also creates a need to be able to store the table after using it. Unfortunately, most picnic tables are too bulky to store conveniently. Thus, it is desirable to have a foldable picnic table which can be collapsed for convenient storing.

Some foldable picnic tables of the prior art require separate pieces to secure the picnic table in an unfolded position. These securement pieces are susceptible to being lost. Other conventional foldable picnic tables are complex in design, requiring simultaneous folding on the table's support pedestals. This can be a cumbersome task. Another disadvantage of conventional foldable picnic tables is that many are made with diagonal support braces or bench supports which limit the leg space of a person seated at the table. Moreover, many of the existing prior art foldable picnic tables are uncomfortable to use either because of the flat benches or the sharp edges of the table.

Still other prior art tables were designed to accommodate adjustments in the height of the table top and the benches. These adjustable tables are generally used either as a table top with benches attached, or as a stage or platform wherein the table and benches may be independently adjusted to coplanar heights. While such picnic tables are convenient for users requiring both a stage or platform and a table top with sitting benches, these prior art adjustable tables are difficult to transport and bulky to store when not in use. Moreover, such prior art tables are bulky and cumbersome in every adjustable position and, more importantly, are devoid of the capability of being selectively foldable into a single, flat configuration, comprising both the table top and benches in a coplanar relationship, for storage.

From the foregoing, it will be appreciated that it would be an advancement in the art to provide a foldable picnic table that is fully self contained and does not have detachable parts. It would be another advancement in the art to provide a foldable picnic table that can be folded, one side at a time, thereby reducing the complexity of operation, while providing a single, flat configuration, comprising both the table top and support benches positioned in a coplanar relationship for storage. It would also be an advancement in the art to provide a foldable picnic table that maximizes the amount of leg room for a person sitting anywhere at the table. It would further be an advancement in the art to provide a foldable picnic table having telescoping pedestals and bench supports that provide means for adjusting the table between a stage or platform position selectively at varying heights or a table top with support benches. Finally, it would be an advancement in the art to provide a comfortable foldable picnic table at which to sit.

Such a foldable picnic table is disclosed and claimed herein.

BRIEF SUMMARY OF THE INVENTION

The present invention is directed to a novel foldable picnic table. The picnic table of the present invention includes a table top supported by two support pedestals. Each support pedestal is pivotally attached to the table top. The support pedestals, in one presently preferred embodiment, include table supports having an inner member and an outer member connected in telescopic engagement. This configuration permits the support pedestals to be positioned between an extended position and a retracted position, and consequently the table top between a table configuration and a platform or stage configuration.

A locking member preferably engages the table supports in such a manner so as to selectively lock the support pedestals in the extended position. The locking member also functions to provide structural support to the table top when disposed in the table configuration or the platform configuration. Alternatively, the support pedestals may be formed having a fixed length, thereby not being extendable between the extended and retracted positions and thus having no need for a locking member.

The foldable picnic table of the present invention further includes at least two benches preferably disposed on opposing sides of the table top. A bench support member is attached to the first support pedestal and pivotally attached to one end of both benches about a first axis of rotation. A second bench support member is attached to the second support pedestal and pivotally attached to the other end of both benches about a second axis of rotation.

Each bench support member includes two telescoping bench supports and a substantially horizontal segment disposed therebetween. The horizontal segment of the bench support member is positioned substantially perpendicular to, and beneath, each bench. The two telescoping bench supports of a single bench support member are attached to the opposing benches and extend substantially outwardly in relation to the horizontal segment. This configuration leaves an unobstructed area directly beneath each of the benches for increased foot space.

The telescoping bench supports are pivotally attached to the bench support member and include an inner member and an outer member connected in telescopic engagement. This configuration permits the telescoping bench supports, and consequently the benches, to be positioned between an extended position and a retracted position. As will be appreciated, a locking member preferably engages the inner and outer members in such a manner so as to selectively lock the benches in the extended position. The locking member also functions to provide structural support to the benches when selectively disposed in the extended position.

When the foldable picnic table of the present invention is disposed in the platform or stage configuration, the table top is positioned in the same plane as the opposing benches. Alternatively, when the foldable picnic table is disposed in the table configuration, the table top and the benches are positioned in a different plane so as to provide a usable table top having bench seating.

In order to dispose the foldable picnic table in a compact storage position, the table top and benches are positioned in the same plane such that the axis of rotation between the first support pedestal and the table top, established by their pivotal connection, is collinear with the first axis of rotation. Likewise, the axis of rotation between the second support pedestal and the table top must be collinear with the second axis of rotation. The table top and the benches must therefore be disposed within the same plane (e.g., either both in the extended position or the retracted position) before the foldable picnic table of the present invention can be disposed in the storage position.

From the foregoing, it will be appreciated that the present invention provides a foldable picnic table having telescoping support pedestals and bench supports for independently adjusting the table top and the benches between a picnic table configuration having a table top and benches for seating or a stage or platform configuration. The present invention also provides a foldable picnic table that can be folded, one side at a time, thereby reducing the complexity of operation when disposing the foldable picnic table in a storage position. The present invention further provides a foldable picnic table that does not require separate pieces to function properly. Finally, the present invention provides a foldable picnic table that maximizes the amount of leg room for a person sitting anywhere at the table.

These and other advantages of the present invention will become more fully apparent by examination of the following description of the preferred embodiments and the accompanying drawings.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 10, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Figure 1:
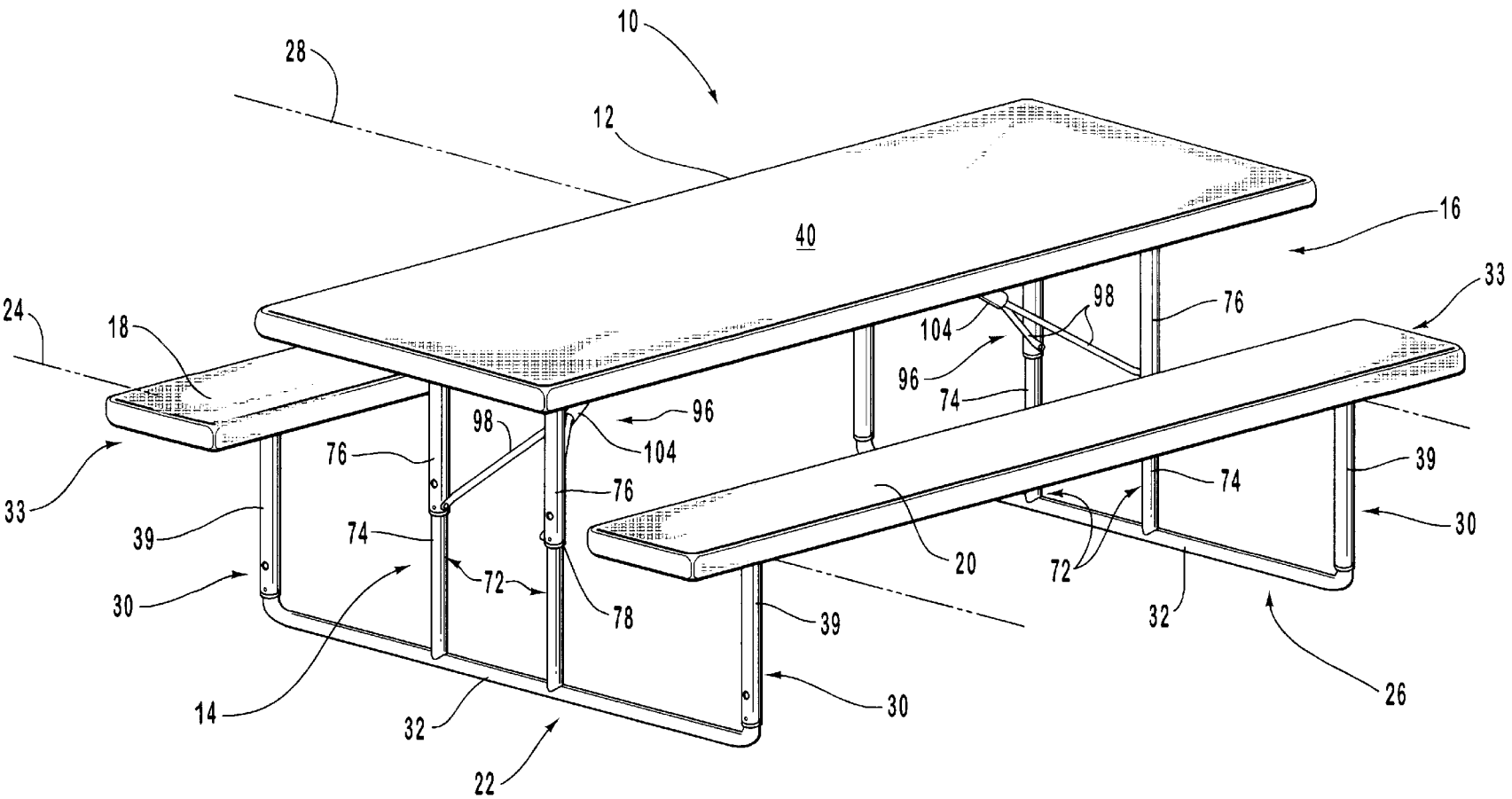
FIG. 1 is a perspective view of one presently preferred embodiment of the foldable picnic table of the present invention with the support pedestals in an extended position and the telescoping bench supports in a retracted position, thereby positioning the table in a picnic table configuration having a table top and bench seating.

With reference to FIG. 1, one presently preferred embodiment of the foldable picnic table according to the present invention is generally designated at 10. As shown, the foldable picnic table 10 includes a table top 12 supported by a first support pedestal 14 and a second support pedestal 16. The foldable picnic table 10 further includes a first bench 18 and a second bench 20. A first bench support member 22 is connected to the first support pedestal 14 and pivotally attached to the first bench 18 and to the second bench 20 about a first axis of rotation 24. A second bench support member 26 is connected to the second support pedestal 16 and pivotally attached to the first bench 18 and to the second bench 20 about a second axis of rotation 28.

Figure 3:
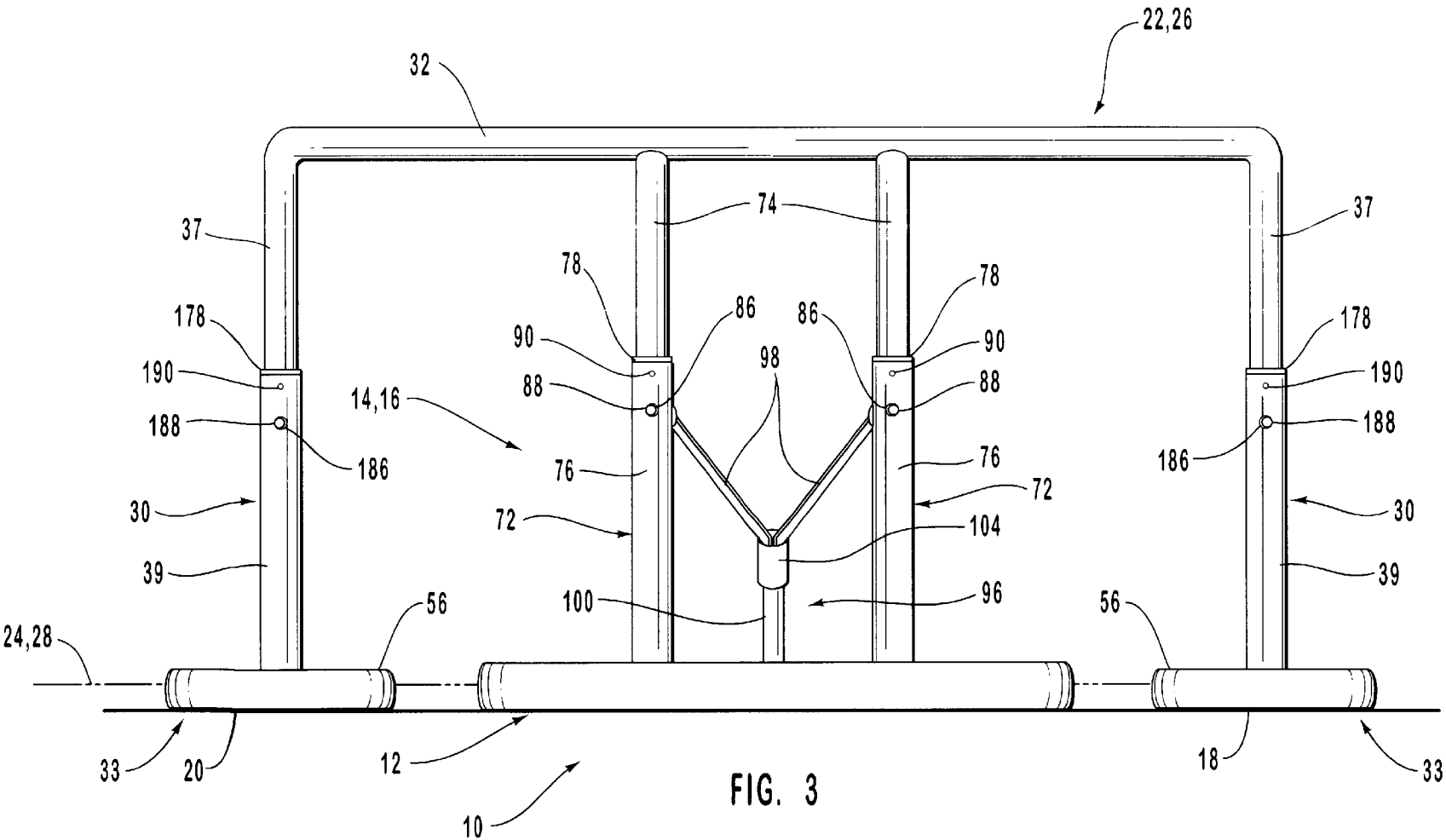
FIG. 3 is a plan end view of the inverted foldable picnic table of FIG. 1 with the telescoping bench supports disposed in an extended position, thereby positioning the table into a stage or platform configuration.
Figure 4:
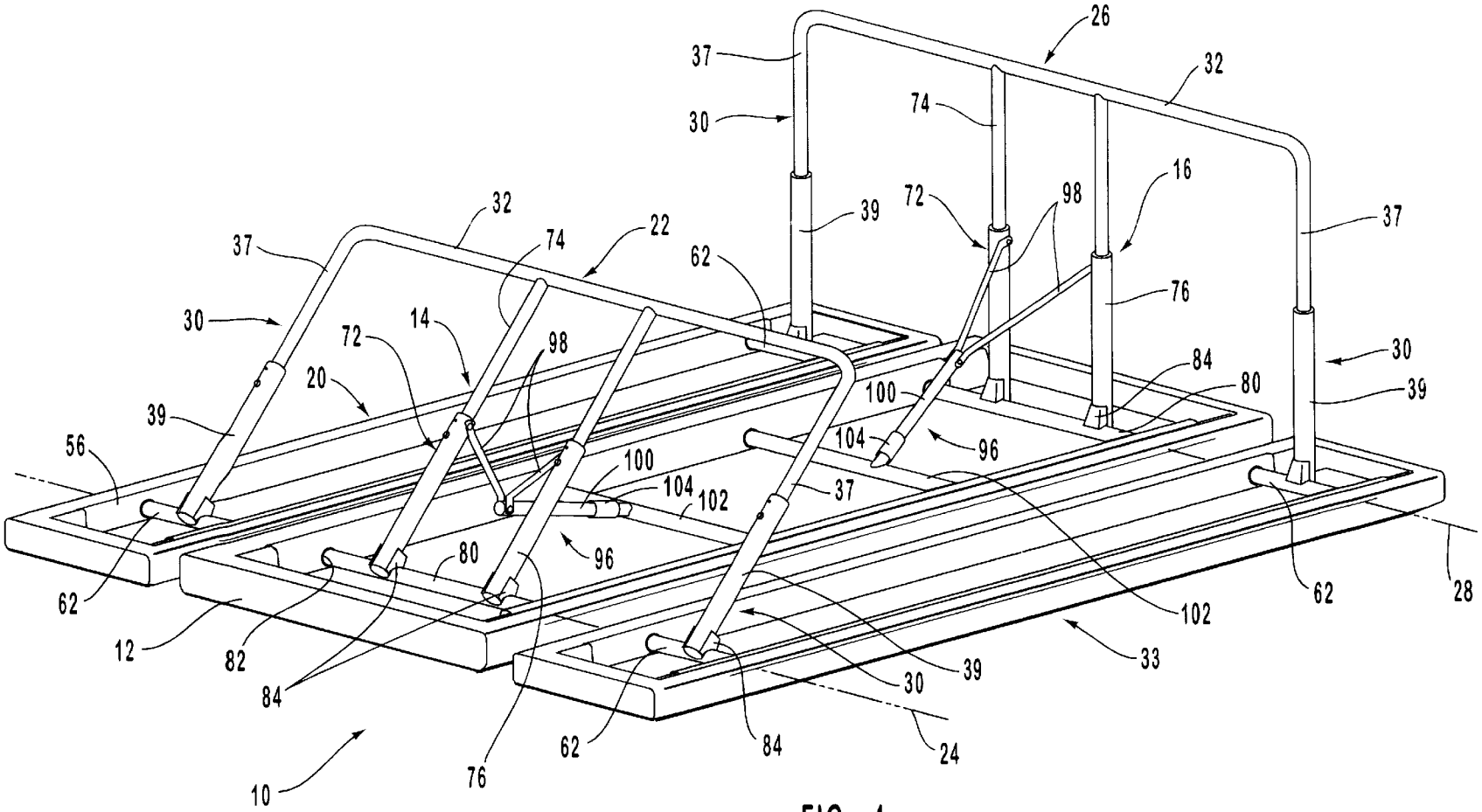
FIG. 4 is a perspective view of the foldable picnic table of FIG. 1 inverted with the telescoping bench supports disposed in the extended position and illustrating one support pedestal and corresponding telescoping bench support in a partially folded position, while showing the support braces in both an elongated position and a folded position.
Figure 5:
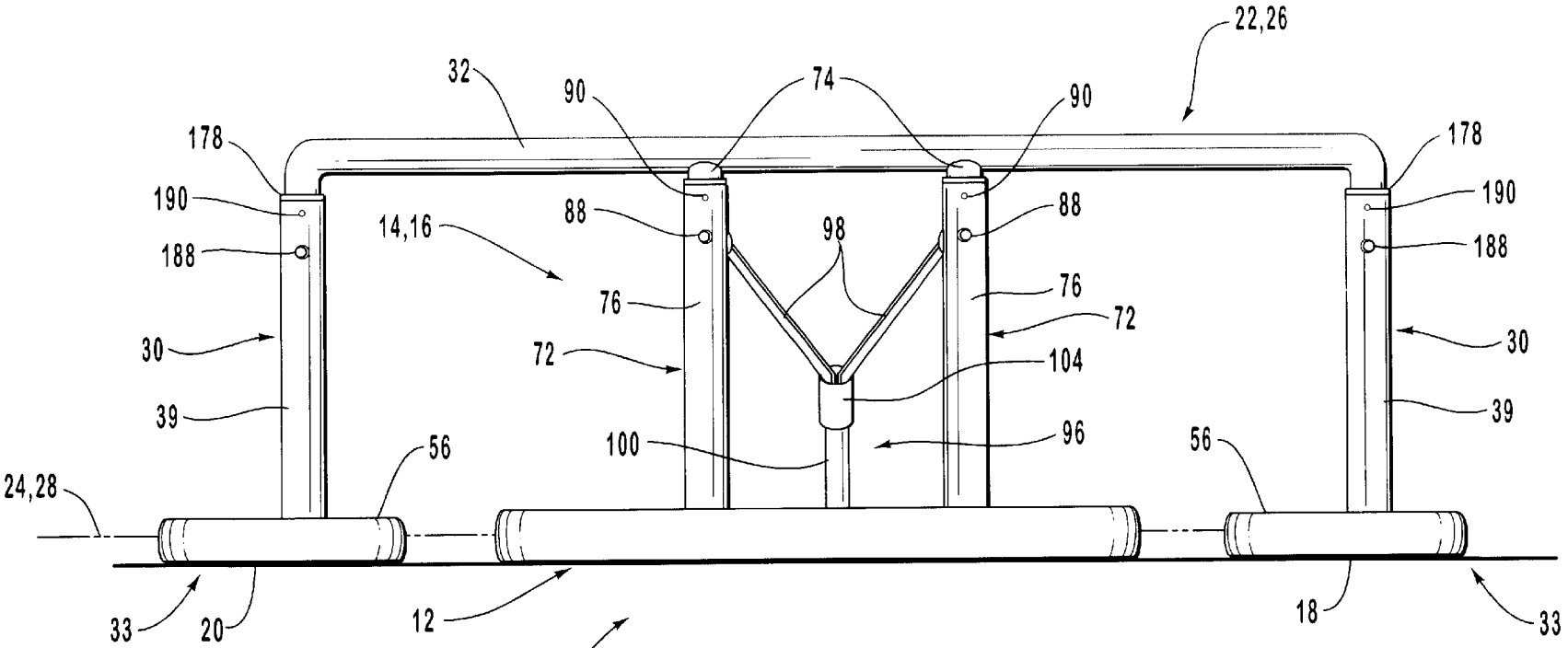
FIG. 5 is a plan end view of the foldable picnic table of FIG. 1 with the support pedestals and the telescoping bench supports in the retracted position, thereby positioning the table into the stage or platform configuration.
Figure 6:
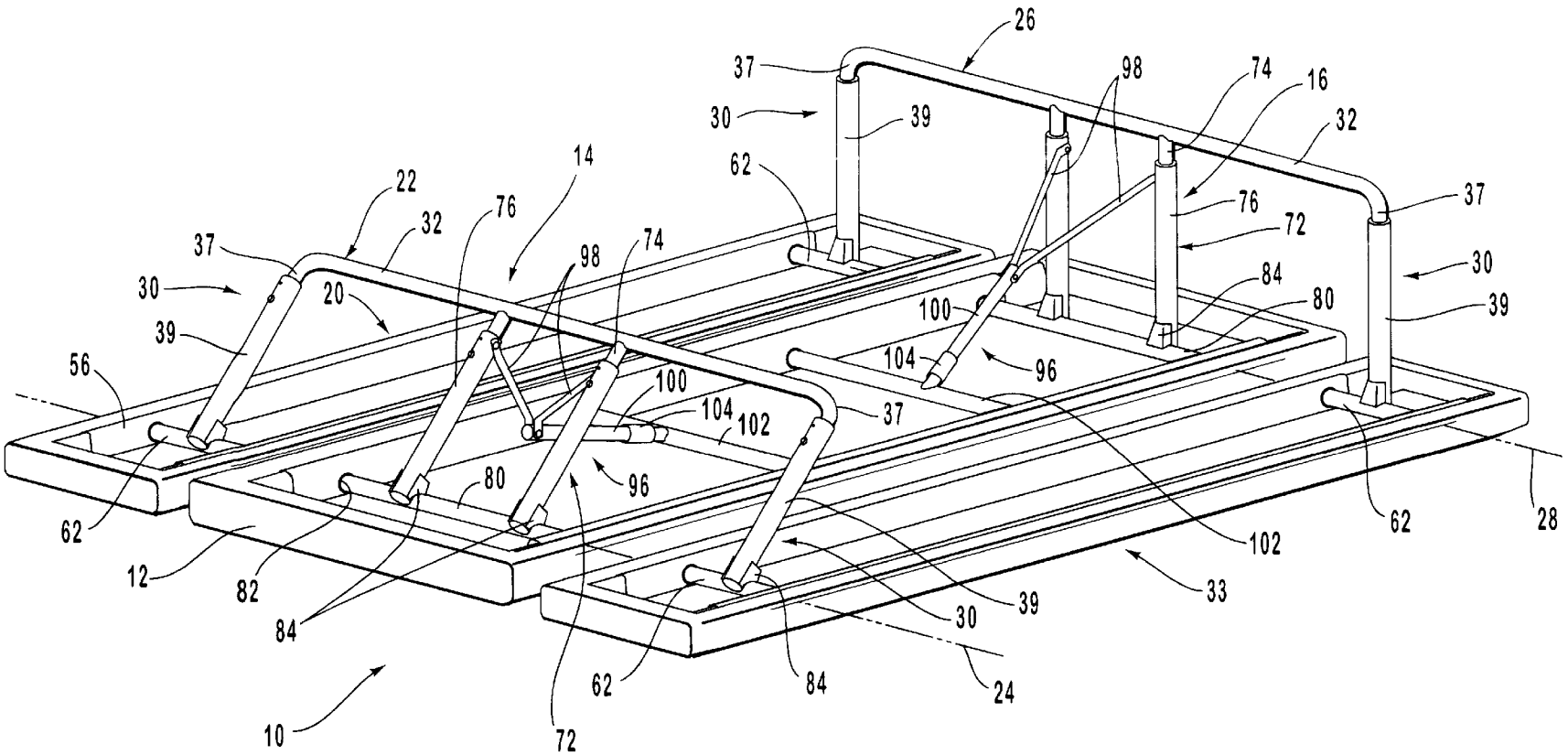
FIG. 6 is a perspective view of the foldable picnic table of FIG. 1 inverted with the support pedestals and the telescoping bench supports disposed in the retracted position and illustrating one support pedestal and corresponding telescoping bench support in a partially folded position, while showing the support braces in both an elongated position and a folded position.

As best shown in FIGS. 4 and 6, the first and second support pedestals 14, 16 are pivotally attached to the table top 12. In one presently preferred embodiment, the support pedestals 14, 16 include table supports 72 having an inner member 74 and an outer member 76 connected in telescopic engagement. This configuration permits the support pedestals 14, 16 to be selectively positionable between an extended position and a retracted position, and consequently the table top 12 between a picnic table configuration having a table top and bench seating and a platform or stage configuration, as illustrated in FIG. 1 and FIGS. 3 and 5, respectively.

A locking member 88 preferably engages the telescoping table supports 72 in such a manner so as to selectively lock the support pedestals 14, 16 in the extended position. The locking member 88 also functions to provide structural support to the table top when disposed in the table configuration or the platform configuration. Alternatively, the support pedestals 14, 16 may be formed having a fixed length, thereby not being extendable between an extended and retracted position and thus having no need for a locking member.

Referring back to FIG. 1, the foldable picnic table 10 of the present invention further includes at least two benches 18, 20 preferably disposed on opposing sides of the table top 12. A first bench support member 22 is attached to the first support pedestal 14 and pivotally attached at a first end of both benches 18, 20 about a first axis of rotation 24. A second bench support member 26 is attached to the second support pedestal 16 and pivotally attached to the second opposing end of both benches 18, 20 about a second axis of rotation 28.

Each bench support member 22, 26 includes two telescoping bench supports 30 joined by a substantially horizontal segment 32. The horizontal segment 32 is positioned substantially perpendicular to, and beneath, each bench 18, 20. Preferably, each bench 18, 20 includes an outer longitudinal edge 33. The horizontal segment 32 of each bench support member 22, 26 extends from at least the outer longitudinal edge 33 of the first bench 18 to at least the outer longitudinal edge 33 of the second bench 20 to engage the telescoping bench supports 30. The telescoping bench supports 30 of each bench support member 22, 26 are pivotally attached to a corresponding bench 18, 20 and extends outwardly to the horizontal segment 32, as best shown in FIGS. 4 and 6. This configuration leaves an unobstructed area directly beneath the bench for increased foot space.

Referring now to FIGS. 3 and 4, the telescoping bench supports 30 include an inner member 37 and an outer member 39 connected in telescopic engagement. This configuration permits the telescoping bench supports 30, and consequently the benches 18, 20, to be positioned between an extended position and a retracted position. As will be appreciated, a locking member 188 preferably engages the inner and outer members 37, 39 in such a manner so as to selectively lock the benches 18, 20 in the extended position. The locking member 188 also functions to provide structural support to the benches 18, 20 when disposed in the extended position.

Figure 2:
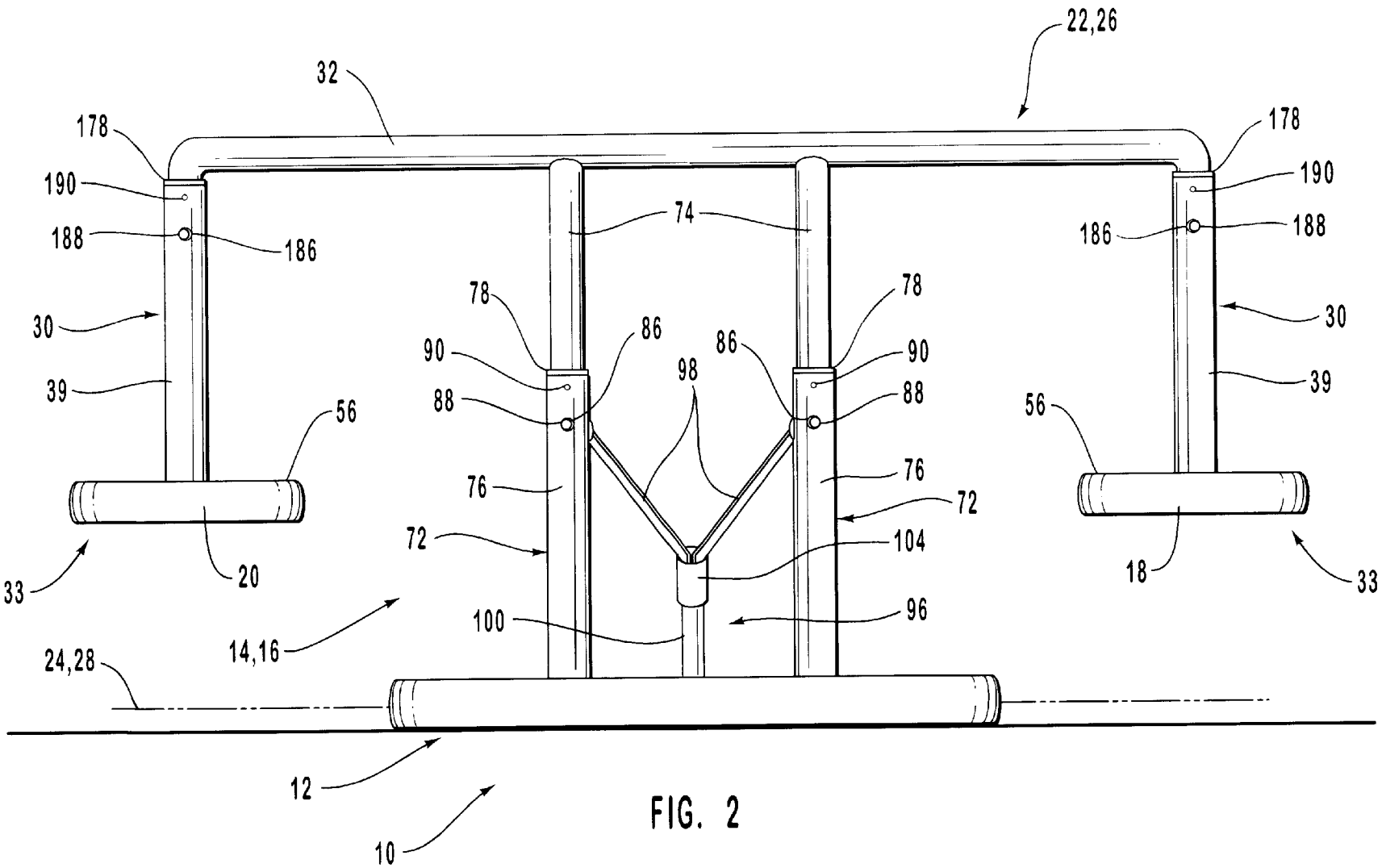
FIG. 2 is a is a plan end view of the inverted foldable picnic table of FIG. 1.

When the foldable picnic table 10 of the present invention is disposed in the stage or platform as illustrated in FIGS. 3 and 5, the table top 12 is positioned in the same plane as the opposing benches 18, 20. In this configuration, the foldable picnic table 10 can be disposed in compact storage by way of pivoting the support pedestals 14, 16 and the bench support members 30 about the first and second axis 24, 28 as shown in FIGS. 4 and 6. Alternatively, when the foldable picnic table 10 is disposed in the picnic table configuration as illustrated in FIGS. 1 and 2, the table top 12 and the benches 18, 20 are positioned in a different plane so as to provide a usable table top with benches for seating. In the picnic table configuration when the table top 12 and the benches 18, 20 are in a different plane, the foldable picnic table 10 is restricted from being disposed in the compact storage position.

With reference now to FIG. 2, each support pedestal 14, 16, in their presently preferred embodiment, includes two substantially parallel telescoping table supports 72. It will be appreciated that the teachings of this invention can be practiced if each support pedestal 14, 16 has more or less than two telescoping table supports 72. Each table telescoping support 72 includes an inner member 74 and an outer member 76 disposed in telescopic engagement. In one presently preferred embodiment, the inner member 74 and the outer member 76 are separated by a hard plastic bushing 78 to facilitate the sliding of the inner member 74 within the internal periphery of the outer member 76. Each bushing 78 is preferably held in place with two small extensions that extend through small holes 90 formed in the outer member 76. Preferably, the bushing 78 extends slightly beyond the edge of the outer member 76 where it flanges outwardly covering the edge of the outer member 76.

Structurally, the telescoping table supports 72 permit the positioning of the support pedestals 14, 16 in the extended position, as illustrated in FIGS. 1 and 2, whereby the table top 12 is positioned in a different plane than the benches 18, 20. The telescoping table supports 72 may also be positioned in the retracted position, as illustrated in FIGS. 5 and 6, whereby the table top 12 is disposed in substantially the same plane as the benches 18, 20.

In the retracted position when the table top 12 and the benches 18, 20 are disposed in substantially the same plane, the axis of rotation between the first support pedestal 14 and the table top 12, established by the pivotal connection between the two, is collinear with the first axis of rotation 24. Correspondingly, the axis of rotation between the second support pedestal 16 and the table top 12, again established by the pivotal connection between the two, is collinear with the second axis of rotation 28.

Structurally similar to the telescoping table supports 72 of the support pedestals 14, 16, the telescoping bench supports 30 permit the positioning of the bench support members 22, 26 in the extended position, as illustrated in FIGS. 3 and 4, whereby the benches 18, 20 are disposed in substantially the same plane as the table top 12. The telescoping bench supports 30 may also be positioned in the retracted position, as illustrated in FIGS. 5 and 6, whereby the benches 18, 20 are disposed in substantially the same plane as the table top 12. As illustrated in FIGS. 4 and 6, when the telescoping table supports 72 and the telescoping bench supports 30 are both in the extended position or the retracted position, and the axis of rotation 24, 28 are aligned, the foldable picnic table 10 is capable of being disposed in a compact storage position. Moreover, the first cross poles 80 supportably engaging the telescoping table supports 72 and the cross poles 62 supportably engaging the telescoping bench supports 30 provide a pivotal engagement which facilitates pivotal movement therebetween.

The foldable picnic table 10 has means for locking the telescoping table supports 72 of the support pedestals 14, 16 in the extended position. As is best illustrated in FIG. 2, the inner 74 and outer 76 members of the telescoping table supports 72, in one presently preferred embodiment, are each configured having at least one retaining aperture 86. The retaining apertures 86 are preferably disposed within the inner and outer members 74, 76 such that the corresponding retaining apertures 86 of the inner and outer members 74, 76 may be disposed in alignment with each other when the telescoping table supports 72, and thus the support pedestals 14, 16, are positioned in the extended position.

Still referring to FIG. 2, the locking member 88 is positioned within each telescoping table support 72 such that a pin may be biased outwardly through the aligned retaining aperture 86 formed in the outer member 76, thereby locking of each telescoping table support 72 in the extended position. In one presently preferred embodiment of the present invention, the locking member 88 comprises a snap pin mechanism. In operation, by supplying a sufficient force to the snap pin mechanism 88, the protruding portion of the biased pin 88 may be removed from the retaining aperture 86 in the outer member 76, thus permitting relative movement between the inner 74 and outer 76 members of the table telescoping support 72 and allowing the support pedestal 14, 16 to be retracted.

It will be apparent that other adjustment mechanisms may be constructed in accordance with the inventive principles set forth herein. For example, a variety of conventional locking members may be utilized for locking the first and second support pedestals 14, 16 in the extended position. It is intended, therefore, that the examples provided herein be viewed as exemplary of the principles of the present invention, and not as restrictive to a particular structure for implementing those principles.

Figure 7:
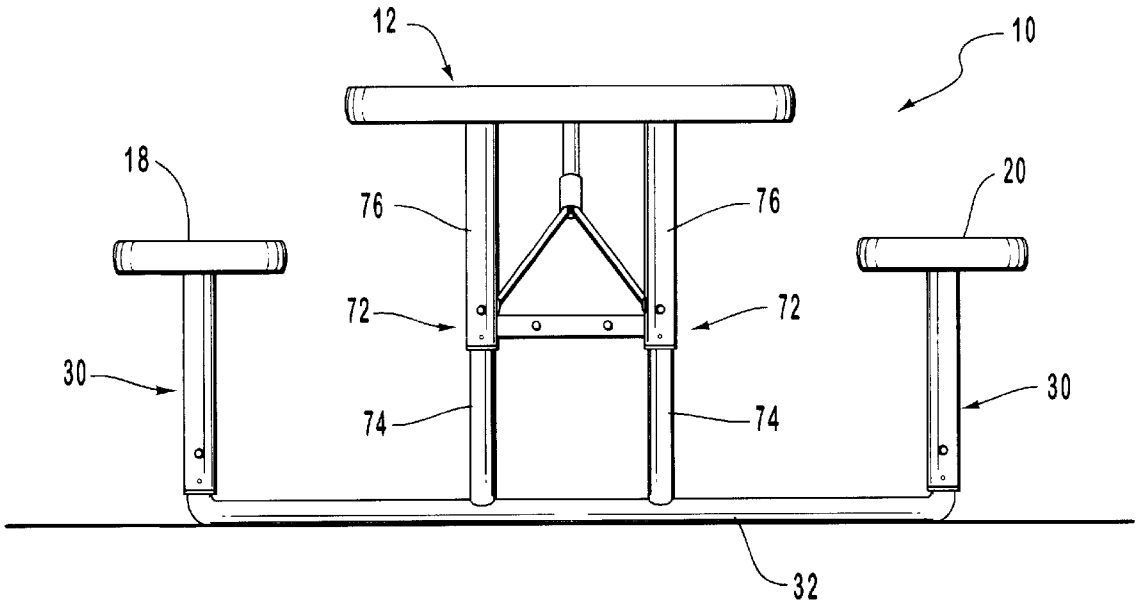
FIG. 7 is an end view of the foldable picnic table of FIG. 1 illustrating the structural relationship of the cross brace locking mechanism and the support pedestals.

With reference now to FIG. 7, another presently preferred embodiment of the locking member for locking the support pedestals 14, 16 in the extended position is illustrated. In this embodiment, retaining apertures are disposed within the inner and outer members 74, 76 of the telescoping table supports 72 such that the retaining apertures align with each other and are opposite each other in the telescoping supports 72 when the support pedestals 14, 16 are in the extended position. As shown, a locking cross brace 110 extends between the two telescoping table supports 72 of each of the support pedestals 14, 16 and is aligned adjacent the corresponding retaining apertures 86.

Figure 8:
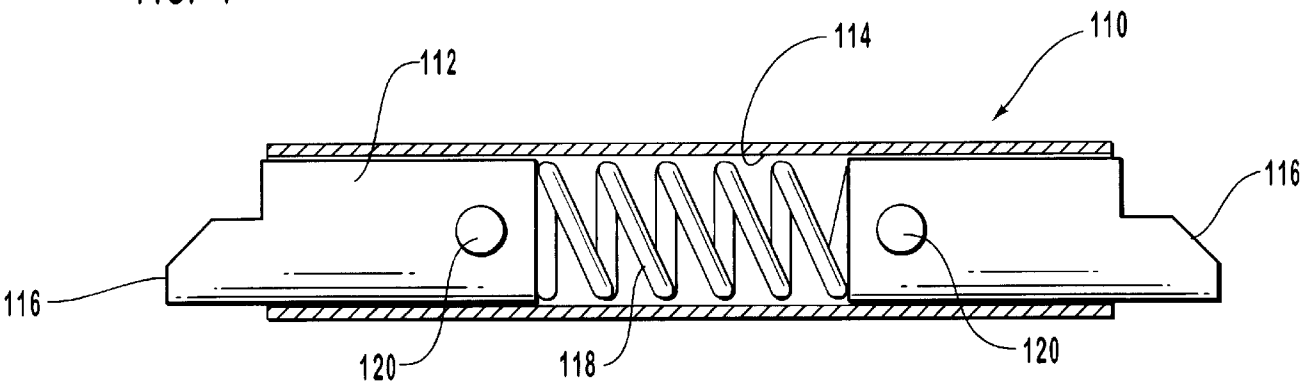
FIG. 8 is a detailed view of the cross brace locking mechanism of FIG. 7.

As best illustrated by FIG. 8, the locking cross brace 110 includes a pair of latches 112 resting in an internal channel 114. The latches 112 are configured with a tab 116 that extends substantially outwardly. The protruding tabs 116 are preferably configured to fit within the aligned retaining apertures 86 formed in the telescoping table supports 72. Each latch 112 is biased outwardly with a spring 118 which rests in the channel 114 between the two latches 112 such that when the retaining apertures become aligned, the tabs 116 are biased into the retaining apertures of the telescoping table supports 72, thereby preventing relative movement between the inner 74 and outer 76 members of each telescoping table support 72.

In one presently preferred embodiment, each latch 112 has an actuation pin 120 that protrudes out of the channel 114 near the spring 118. The actuation pins 120 are spaced sufficiently close to each other such that both pins can be grasped by one hand of a user. This allows the user to squeeze the latches 112 together within the channel 114, compressing the spring 118 and withdrawing the tabs 116 out of the retaining apertures formed in the telescoping table supports 72. In operation, this action permits relative movement between the inner 74 and outer members 76 of the telescoping table supports 72.

With reference now to FIGS. 4 and 6, the support pedestals 14, 16 are pivotally attached to the table top 12. A first end of each of the outer members 76 of the telescoping table supports 72 are connected to the table top 12 by means of a first cross pole 80. Opposing ends of the first cross pole 80 are introduced within openings 82 disposed within opposite sides of a table top frame. The first cross pole 80, under conditions discussed below, rotates within the openings 82 formed within the table top frame. In one presently preferred embodiment, each telescoping table support 72 is secured to the first cross pole 80 by offset brackets 84 such that when the support pedestals 14, 16 are folded into substantially the same plane as the table top 12 for compact storage of the foldable picnic table 10, the pedestals 14, 16 lie substantially flat.

As best illustrated in FIGS. 4 and 6, each support pedestal 14, 16 is connected to the table top 12 by a support brace 96. In one presently preferred embodiment, the support brace 96 comprises a diagonal brace having two angled members 98 connected at one end to a respective one of the outer members 76 of each table telescoping support 72. The opposing ends of the angled members 98 are pivotally connected to a first end of an elongated section 100. Correspondingly, the second end of the elongated member 100 is preferably attached to a second cross pole 102. The opposing ends of the second cross-pole 102 are positioned within openings 82 formed within opposite sides of the table top frame 34, thus allowing the second cross-pole 102 to rotate within the openings 82.

Referring still to FIGS. 4 and 6, the support brace 96 can be disposed in an extended position for structural support or folded into a collapsed storage position. When the diagonal brace 96 is disposed in the extended position, the two angled members 98 and the elongated member 100 each have a portion which overlap. Moreover, the diagonal brace 96 is preferably configured with a collar 104 sized to fit around the overlapping portion when disposed in the extended position, thus locking the diagonal brace in its extended position.

When the foldable picnic table 10 is disposed in the picnic table configuration, as illustrated in FIG. 1, and the diagonal brace 96 is extended, the collar 104 may be placed over the overlapping portion of the diagonal brace 96. In this position, the foldable picnic table 10 is ready for use. When the user desires to collapse the table for storage, a preferred method is to invert the foldable picnic table 10, as illustrated in FIG. 2. The user then depresses the biased locking member 88 or squeezes the actuation pins 120 together, unlocking a respective support pedestal 14, 16. This allows the inner member 74 of each telescoping table support 72 to retract into the outer member 76 thereby shortening the length of the support pedestals 14, 16 and disposing the pedestals into the retracted position, as illustrated in FIGS. 5 and 6.

With the support pedestals 14, 16 in the retracted position, the first axis of rotation 24 created by the pivotal connection between the first bench support member 22 and the first and second benches 18, 20 and the axis of rotation created by the pivotal connection between the support pedestals 14, 16 and the table top 12 are collinear. This permits the first bench support member 22 and the first pedestal 14 to rotate about the collinear axes. In a similar fashion, the second bench support member 26 and second support pedestal 16 can also rotate about collinear axes when the support pedestals 14, 16 are in the retracted position.

With the foldable picnic table 10 still in the inverted position, the collar 104 may be slid away from the overlapping portion, as illustrated in FIG. 6. This, along with the retracted position of the support pedestals 14, 16 allows the diagonal brace 96 to be folded and permits the pedestals 14, 16, together with the first and second bench support members 22, 26, to be folded inwardly toward the table top 12. With the foldable picnic table 10 in the folded position, the table can easily be moved and stored.

Structurally similar to the telescoping table supports 72 of the support pedestals 14, 16, the telescoping bench supports 30 include at least one locking member for locking the benches 18, 20 in an extended position. As best illustrated in FIG. 3, the inner and outer members 37, 39 of the telescoping bench supports 30, in one presently preferred embodiment, are each configured having at least one retaining aperture 186. The retaining aperture 186 are preferably disposed within the inner and outer members 37, 39 such that the corresponding retaining apertures 186 of the inner and outer members 37, 19 may be disposed in alignment with each other when the telescoping bench supports 30 are positioned in the extended position.

Still referring to FIG. 3, the locking member 188 is positioned within each telescoping bench support 30 such that a pin may be biased outwardly through the aligned retaining aperture 186 formed in the outer member 76, thereby locking of each telescoping bench support 30 in the extended position. In one presently preferred embodiment of the present invention, the locking member 188 comprises a snap pin mechanism. In operation, by applying a sufficient force to the snap pin mechanism 188, the protruding portion of the biased pin may be selectively removed from engagement with the retaining aperture 186 in the outer member 39, thus permitting relative movement between the inner 37 and outer 39 members of the telescoping bench support 30 to allow the bench 18, 20 to be retracted into the retracted position, as illustrated in FIGS. 5 and 6.

It will be apparent that other adjustment mechanisms may be constructed in accordance with the inventive principles set forth herein. For example, a variety of conventional locking members may be utilized for locking the telescoping bench supports 30 in the extended position. It is intended, therefore, that the examples provided herein be viewed as exemplary of the principles of the present invention, and not as restrictive to a particular structure for implementing those principles.

It will be appreciated that the teachings of this invention can be practiced if each bench 18, 20 has more or less than two telescoping bench supports 30. Each telescoping bench support 30 includes an inner member 37 and an outer member 39 disposed in telescopic engagement. In one presently preferred embodiment, the inner member 37 and the outer member 39 are separated by a hard plastic bushing 178 to facilitate the sliding of the inner member 37 in relation to the internal periphery of the outer member 39. Each bushing 178 is preferably held in place with two small extensions that extend through small holes 190 formed in the outer member 39. Preferably, the bushing 178 extends slightly beyond the edge of the outer member 39 where it flanges outwardly covering the edge of the outer member 39.

Figure 10:
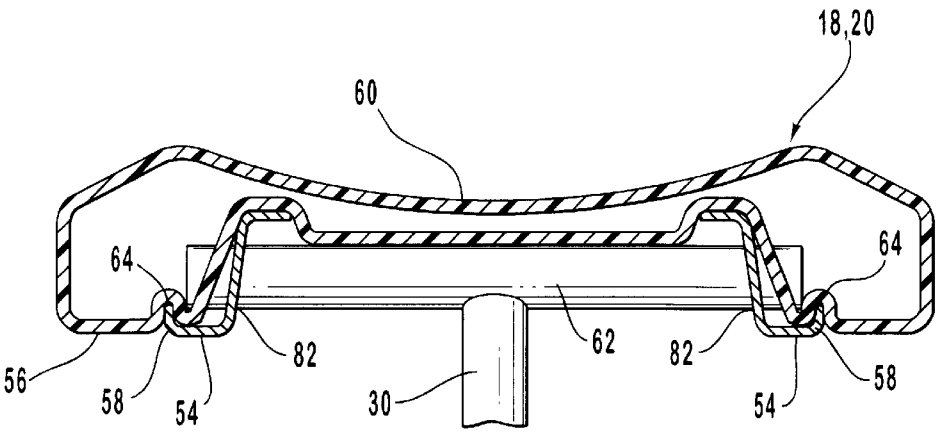
FIG. 10 is a cross-sectional plan view of an alternate embodiment of a bench of the foldable picnic table.

With reference now to FIGS. 4 and 6, the telescoping bench supports 30 of the bench support members 22, 26 are pivotally attached to the table top 12. A first end of each of the outer members 39 of the telescoping bench supports 30 are preferably connected to the table top 12 by means of a cross pole 62. Opposing ends of the cross pole 62 are introduced within openings 82 disposed within opposite sides of a bench frame 54, as illustrated in FIG. 10. The cross pole 62, under conditions discussed below, rotates within the openings 82 formed within the bench frame 54. In one presently preferred embodiment, each telescoping bench support 30 is secured to the cross pole 62 by offset brackets 84 such that when the bench support members 22, 26 are folded into substantially the same plane as the table top 12 for compact storage of the foldable picnic table 10, the benches 18, 20 lie substantially flat adjacent and on opposing sides of the table top 12.

When the foldable picnic table 10 of the present invention is disposed in the platform or stage configuration as best shown in FIGS. 3 and 5 (although inverted), the table top 12 is positioned in the same plane as the benches 18, 20. Alternatively, when the foldable picnic table 10 is disposed in the table configuration as best shown in FIG. 1, the table top 12 and the benches 18, 20 are positioned in a different plane so as to provide a usable table top having bench seating.

Referring now to FIGS. 3–6, in order to dispose the foldable picnic table 10 in the compact storage position, the table top 12 and benches 18, 20 are positioned in the same plane such that the axis of rotation between the first support pedestal 14, the first bench support member 22 and the table top 12, established by their pivotal connection, is collinear with the first axis of rotation 24. Likewise, the axis of rotation between the second support pedestal 16, the second bench support member 26 and the table top 12 must be collinear with the second axis of rotation 28. The table top 12 and the benches 18, 20 must therefore be disposed within the same plane (e.g., both the telescoping table supports 72 and the telescoping bench supports 30 must be correspondingly positioned in either the extended position or the retracted position) before the foldable picnic table 10 of the present invention can be disposed in the storage position.

Figure 9:
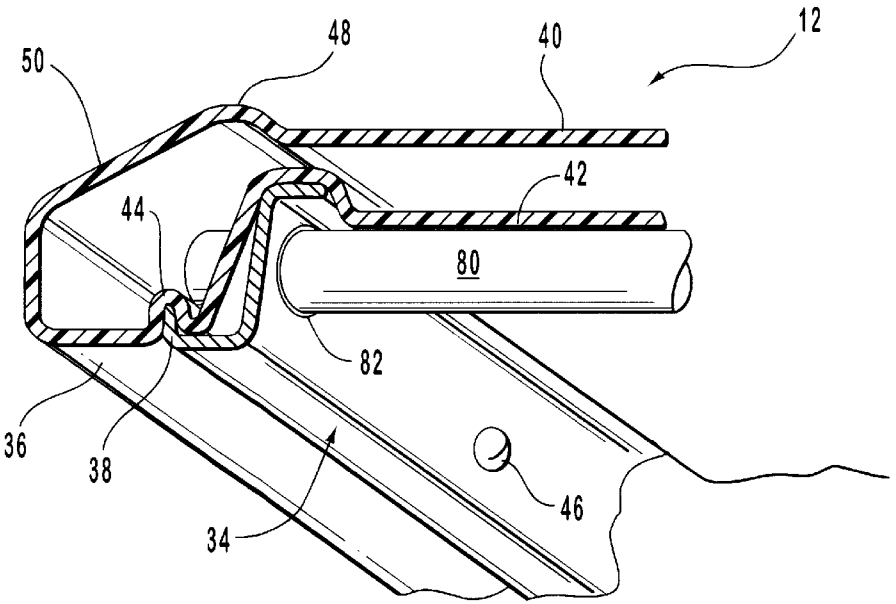
FIG. 9 is a perspective cutaway view of the table top of the foldable picnic table of FIG. 1.

With reference now to FIG. 9, the table top 12 includes a table top frame 34 and a table top counter 36. In one presently preferred embodiment of the present invention, the table top frame 34 if formed having a generally rectangular configuration. The table top frame 34 preferably consists of a rigid support having a substantially S-shaped cross-section. One end of the S-shaped cross-section may be formed having locking lip 38 to help secure the snug fit of the table top counter 36 over the frame 34.

Although the present invention is illustrated and described in connection with a generally rectangular configuration, those skilled in the art will recognize that various other geometrical configurations are likewise suitable. The use of a generally rectangular configuration is thus by way of illustration only and not by way of limitation.

The table top counter 36 is preferably formed having a substantially hollow shell. In one presently preferred embodiment, the table top counter 36 is blow-molded out of plastic. Functionally, the table top counter 36 provides a functional surface 40 and a mounting surface 42. As illustrated in the embodiment shown in FIG. 9, the mounting surface 42 of the table top counter 36 is configured to conform generally to the shape of the table top frame 34. The table top counter 36 of the preferred embodiment fits snugly over the table top frame 34 and includes a notch 44 in which the locking lip 38 of the frame 34 fits.

The table top frame 34 is preferably attached to the table top counter 36 by fasteners 46 which penetrate both the table top frame 34 and an adjacent point of the mounting surface 42. It will be readily appreciated by those skilled in the art that a variety of shapes may be used for the table top frame 34 and the mounting surface 42 of the table top counter 36. Additionally, the fasteners for attaching the frame 34 to the table top counter 36 are conventional in the art. Various attachment methods may, accordingly, be employed which include, for example, rivets, screws, bolts, adhesives or the like.

FIG. 9 illustrates one presently preferred embodiment of the functional surface 40 of the table top counter 36. In this embodiment, the functional surface 40 has a raised perimeter 48 configured such that things spilled on the functional surface 40 of the table top counter 36 will not drip over the edge of the table top 12. The raised perimeter 48 preferably extends approximately one sixteenth of an inch above the functional surface 40 of the table top counter 36. In a preferred embodiment, the outer edges 50 of the functional surface 40 of the table top counter 36 are bevelled at approximately a fifteen degree angle to increase the comfort of a person resting their arm against the edge of the table top 12.

FIG. 10 also illustrates a cutaway view of one of the benches 18, 20. The benches 18, 20 each include a bench frame 54 and a bench counter 56. Each bench frame 54 in one presently preferred embodiment has a substantially S-shaped cross-section. Like the table top frame 34, one end of the S-shaped cross-section of the bench frame 54 may be con-figured with a locking lip 58.

The bench counter 56 is preferably formed having a substantially hollow blow-molded shell of the same material as the table top counter 36. The bench 18, 20 includes a sitting surface 60 and a mounting surface 62. As illustrated in FIGS. 9 and 10, the mounting surface 62 of the bench counter 56 is configured to conform generally to the shape of the bench frame 54. The bench counter 56 fits snugly over the bench frame 54 and includes a notch 64 in which the locking lip 58 of the frame 54 fits. In a preferred embodiment, the bench frame 54, like the table top frame 34, is attached to the bench counter 56 by means of bench fasteners which penetrate the frame 54 and an adjacent point in the mounting surface 62. As with the table top frame 34 and counter 36, it will be appreciated that a variety of configurations may be used for the bench frame 54 and mounting surface 62 of the bench counter 56. Additionally, the means employed to attach the bench frame 54 to the counter 56 may include any of those known in the art.

In one presently preferred embodiment as shown in FIG. 1, the sitting surface 60 of the benches 18, 20 is substantially flat along its linear length. As best illustrated in FIG. 10, an alternate preferred embodiment of the sitting surface 60 of the benches 18, 20 may include a concave surface formed along the length of the bench counter 56. FIG. 10 also illustrates how the outer edge of the sitting surface 60 of the bench counter 56 is bevelled. For example, in one presently preferred embodiment, the outer edge of the sitting surface 60 may be bevelled at approximately a 15° angle.

The table top frame 34 of FIG. 9 and the bench frame 54 of FIG. 10 are preferably made of a substantially rigid material. For example, the table top frame 34 and the bench frame 54 may be formed of metal, wood, fiberglass, polymeric or composite materials, ceramic, or any other suitable rigid material.

Preferably, the table top counter 36 and the bench counter 56 are made of a substantially sturdy material. For example, the table top counter 36 and the bench counter 56 may be formed of wood, rubber, or any of numerous organic, synthetic, or processed materials that are mostly thermoplastic or thermosetting polymers of high molecular weight with or without additives, such as, plasticizers, auto oxidants, extenders, colorants, ultraviolet light stabilizers, or fillers, which can be shaped, molded, cast, extruded, drawn, foamed, or laminated into objects, films, or filaments, or any other suitable sturdy material.

Many of the problems associated with conventional picnic tables are addressed by the teachings of the present invention. The foldable picnic table of the present invention includes telescoping support pedestals and bench supports for independently adjusting the table top and the benches between a picnic table configuration having a table top and benches for seating and a stage or platform configuration. The present invention also provides a foldable picnic table that can be folded, one side at a time, thereby reducing the complexity of operation when disposing the foldable picnic table in a storage position. The present invention further provides a foldable picnic table that does not require separate pieces to function properly. In addition, the present invention provides a foldable picnic table that maximizes the amount of leg room for a person sitting anywhere at the table.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A foldable picnic table positionable between a picnic table configuration, a platform configuration, and a storage position, said foldable picnic table comprising:

a table top;

a first and second support pedestal, the support pedestals pivotally attached to the table top, each of the support pedestals including a table support comprising an inner member and an outer member connected in telescopic engagement, the telescoping table supports adapted to be selectively positioned between an extended position and a retracted position;

a first and second bench disposed on opposing sides of the table top;

a first bench support member attached to the first support pedestal and pivotally attached to the first bench and to the second bench about a first axis of rotation, the first bench support member including a bench support comprising an inner member and an outer member connected in telescopic engagement, the telescoping bench supports adapted to be selectively positionable between an extended position and a retracted position;

a second bench support member attached to the second support pedestal and pivotally attached to the first bench and to the second bench about a second axis of rotation, the second bench support member comprising a bench support having an inner member and an outer member connected in telescoping engagement, the telescoping bench supports adapted to be selectively positionable between an extended position and a retracted position;

the platform configuration of the foldable picnic table configured such that the benches are selectively positioned in substantially the same plane as the table top;

the picnic table configuration of the foldable picnic table configured such that the benches are selectively positioned in a different plane than the table top; and the storage position of said foldable picnic table configured such that with the benches disposed in substantially the same plane as the table top, the axis of rotation between the first support pedestal and the table top is collinear with the first axis of rotation and the axis of rotation between the second support pedestal and the table top is collinear with the second axis of rotation, thereby permitting the bench support members and the support pedestals to be moved between a perpendicular position in which the support pedestals and bench support members are disposed perpendicular to the table top and a folded position in which the support pedestals and bench support members are folded into substantially the same plane as the table top.

2. The foldable picnic table as defined in claim 1, further comprising a locking member adapted to engage the telescoping table support to selectively lock the support pedestal in the extended position.

3. The foldable picnic table as defined in claim 2, wherein the locking member comprises a locking cross brace.

4. The foldable picnic table as defined in claim 2, wherein the locking member comprises a biased pin.

5. The foldable picnic table as defined in claim 1, wherein the inner and outer members of the telescoping table support comprise a retaining aperture having an internal periphery sufficient for passing at least a portion of said locking member therethrough.

6. The foldable picnic table as defined in claim 1, further comprising a locking member adapted to engage the telescoping bench support to selectively lock the bench in the extended position.

7. The foldable picnic table as defined in claim 6, wherein the inner and outer members of the telescoping bench support comprise a retaining aperture having an internal periphery sufficient for passing at least a portion of said locking member therethrough.

8. The foldable picnic table as defined in claim 6, wherein the locking member comprises a biased pin.

9. The foldable picnic table as defined in claim 1, further comprising a support brace connecting the table top to each support pedestal, wherein the support brace is foldable and lockable in an extended position.

10. The foldable picnic table as defined in claim 9, wherein each support brace is foldable, thereby allowing each support pedestal to pivot toward the table top when disposing the table in the storage position, each support brace having a lockable extended position in which relative movement between the table top and the support pedestal is substantially prevented.

11. The foldable picnic table as defined in claim 9, wherein the support brace comprises a diagonal brace.

12. The foldable picnic table as defined in claim 1, wherein the table top comprises a table top frame and a table top counter, the table top counter having a functional surface and a mounting surface.

13. The foldable picnic table as defined in claim 12, wherein the functional surface of the table top counter is configured with a raised perimeter to prevent spillage off the functional surface of the table top counter.

14. The foldable picnic table as defined in claim 12, wherein the functional surface of the table top counter includes beveled outer edges to better accommodate a user resting an arm against the edge of the table top.

15. The foldable picnic table as defined in claim 1, wherein each bench comprises a bench frame and a bench counter, the bench counter having a sitting surface and a mounting surface.

16. The foldable picnic table as defined in claim 15, wherein the sitting surface of the bench counter is flat along its length, the sitting surface of the bench counter having bevelled outer edges.

17. The foldable picnic table as defined in claim 15, wherein the sitting surface of the bench counter is concave along its length, the sitting surface of the bench counter having bevelled outer edges.

18. The foldable picnic table as defined in claim 1, wherein each support pedestal comprises two substantially parallel telescoping table supports.

19. The foldable picnic table as defined in claim 1, wherein the inner and outer members of the telescoping table support comprise substantially concentric cylinders.

20. The foldable picnic table as defined in claim 1, wherein the inner and outer members of the telescoping bench support comprise substantially concentric cylinders.

21. A foldable picnic table positionable between a picnic table configuration, a platform configuration, and a storage position, said foldable picnic table comprising:

a table top;

a first and second support pedestal, the support pedestals pivotally attached to the table top;

a first and second bench disposed on opposing sides of the table top;

a first bench support member attached to the first support pedestal and pivotally attached to the first bench and to the second bench about a first axis of rotation, the first bench support member including a bench support comprising an inner member and an outer member connected in telescopic engagement, the telescoping bench supports adapted to be selectively positionable between an extended position and a retracted position;

a second bench support member attached to the second support pedestal and pivotally attached to the first bench and to the second bench about a second axis of rotation, the second bench support member comprising a bench support having an inner member and an outer member connected in telescoping engagement, the telescoping bench supports adapted to be selectively positionable between an extended position and a retracted position;

the platform configuration of the foldable picnic table configured such that the benches are selectively positionable in substantially the same plane as the table top;

the picnic table configuration of the foldable picnic table configured such that the benches are selectively positionable in a different plane than the table top; and the storage position of said foldable picnic table configured such that with the benches disposed in substantially the same plane as the table top, the axis of rotation between the first support pedestal and the table top is collinear with the first axis of rotation and the axis of rotation between the second support pedestal and the table top is collinear with the second axis of rotation, thereby permitting the bench support members and the support pedestals to be moved between a perpendicular position in which the support pedestals and bench support members are disposed perpendicular to the table top and a folded position in which the support pedestals and bench support members are folded into substantially the same plane as the table top.

22. The foldable picnic table as defined in claim 21, further comprising a locking member adapted to engage the telescoping table support to selectively lock the support pedestal in the extended position.

23. The foldable picnic table as defined in claim 22, wherein the inner and outer members of the telescoping table support comprise a retaining aperture having an internal periphery sufficient for passing at least a portion of said locking member therethrough.

24. The foldable picnic table as defined in claim 22, wherein the locking member comprises a biased pin.

25. The foldable picnic table as defined in claim 22, wherein the locking member comprises a locking cross brace.

26. The foldable picnic table as defined in claim 21, further comprising a locking member adapted to engage the telescoping bench support to selectively lock the bench in the extended position.

27. The foldable picnic table as defined in claim 26, wherein the inner and outer members of the telescoping bench support comprise a retaining aperture having an internal periphery sufficient for passing at least a portion of said locking member therethrough.

28. The foldable picnic table as defined in claim 26, wherein the locking member comprises a biased pin.

29. The foldable picnic table as defined in claim 21, further comprising a support brace connecting the table top to each support pedestal, wherein the support brace is foldable and lockable in an extended position.

30. The foldable picnic table as defined in claim 29, wherein each support brace is foldable, thereby allowing each support pedestal to pivot toward the table top when disposing the table in the storage position, each support brace having a lockable extended position in which relative movement between the table top and the support pedestal is substantially prevented.

31. The foldable picnic table as defined in claim 29, wherein the support brace comprises a diagonal brace.

32. The foldable picnic table as defined in claim 21, wherein the table top comprises a table top frame and a table top counter, the table top counter having a functional surface and a mounting surface.

33. The foldable picnic table as defined in claim 32, wherein the functional surface of the table top counter is configured with a raised perimeter to prevent spillage off the functional surface of the table top counter.

34. The foldable picnic table as defined in claim 33, wherein the functional surface of the table top counter includes beveled outer edges to better accommodate a user resting an arm against the edge of the table top.

35. The foldable picnic table as defined in claim 21, wherein each bench comprises a bench frame and a bench counter, the bench counter having a sitting surface and a mounting surface.

36. The foldable picnic table as defined in claim 35, wherein the sitting surface of the bench counter is flat along its length, the sitting surface of the bench counter having bevelled outer edges.

37. The foldable picnic table as defined in claim 35, wherein the sitting surface of the bench counter is concave along its length, the sitting surface of the bench counter having bevelled outer edges.

38. The foldable picnic table as defined in claim 21, wherein each support pedestal comprises two substantially parallel telescoping table supports.

39. The foldable picnic table as defined in claim 21, wherein the inner and outer members of the telescoping bench supports comprise substantially concentric cylinders.

* * * * *